US005915471A

United States Patent [19]

Kim

[11] Patent Number: 5,915,471

[45] Date of Patent: Jun. 29, 1999

[54] HEAT EXCHANGER OF AIR CONDITIONER

[75] Inventor: Young-Saeng Kim, Inchun, Rep. of Korea

[73] Assignee: Samsung Electronics Co., Ltd., Suwon, Rep. of Korea

[21] Appl. No.: 08/890,562

[22] Filed: Jul. 9, 1997

[30] Foreign Application Priority Data

Jul. 9, 1996 [KR] Rep. of Korea ..... 96-27642

[51] Int. Cl.[6] ..... F28D 1/04; F28F 1/32

[52] U.S. Cl. ..... 165/151; 165/181; 165/DIG. 503

[58] Field of Search ..... 165/151, 181

[56] References Cited

U.S. PATENT DOCUMENTS

| | | | |
|---|---|---|---|
| 4,550,776 | 11/1985 | Lu | 165/151 |
| 4,723,600 | 2/1988 | Yokoyama et al. | 165/151 |
| 4,832,117 | 5/1989 | Kato et al. | 165/151 |
| 5,509,469 | 4/1996 | Obosu | 165/151 |
| 5,685,367 | 11/1997 | Jun | 165/151 |
| 5,706,885 | 1/1998 | Kim | 165/151 |
| 5,722,485 | 3/1998 | Love et al. | 165/151 |
| 5,794,690 | 8/1998 | Kim et al. | 165/151 |

*Primary Examiner*—Leonard Leo
*Attorney, Agent, or Firm*—Burns, Doane, Swecker & Mathis, L.L.P.

[57] ABSTRACT

The present invention relates to a heat exchanger of an air conditioner having a plurality of flat fins, each arranged in parallel at a predetermined interval to allow fluid to flow thereamong and a plurality of heat transfer pipes insertedly arranged in perpendicular patterns to the plurality of the flat fins to allow the fluid to internally flow, the heat exchanger comprising a plurality of louvered grid groups symmetrically opened in a forward and a reverse flowing direction of air current and radially disposed to encompass an upper and a lower side of the heat transfer pipes, so that the air current flowing though the plurality of flat fins can become turbulent and mixed around the heat transfer pipes to thereby reduce a cavitation region generating at the back of the plurality of heat transfer pipes and concurrently to increase a heat transfer efficiency, the heat exchanger further having an advantage in that a bead part is bent toward an inner side of the flat fin so as to be centrally and perpendicularly positioned at the louvered grid groups against the upper and lower sides of heat transfer pipes, so that superficial area of the flat fin can be enlarged and concentrated water (by way of example, dew) generated by temperature difference between the refrigerant flowing in the heat transfer pipes and the air current flowing through the flat fins can be smoothly drained out when the beat exchanger is used as an evaporator for cooling or as a concentrator.

4 Claims, 4 Drawing Sheets

HEAT EXCHANGER OF AIR CONDITIONER

BACKGROUND OF THE INVENTION

Field of the Invention

The present invention relates to a heat exchanger of an air conditioner, and more particularly to a heat exchanger of an air conditioner arranged with a plurality of louvered grid groups at upper and lower sides of a plurality of heat transfer pipes to cause flowing air current (by way of example, room air) to become turbulent and mixed for a better heat exchange result and concurrently to cause a cavitation region generating at the back of the plurality of heat transfer pipes to be reduced.

DESCRIPTION OF THE INVENTION

Generally, a heat exchanger used for an air conditioner includes, as illustrated in FIG. 1, a plurality of flat fins, each being arranged in parallel at a predetermined interval and a plurality of heat transfer pipes 2 each being disposed in perpendicular to the flat fin 1, and at the same time, arranged in zigzag patterns.

At this location, a fluid (by way of example, room air) flows through the plurality of flat fins 1 along an arrow direction to thereby heat-exchange with fluid in the heat transfer pipes 2.

However, there is a problem in the conventional heat exchanger in that heat transfer rate of heat fluid around the flat fins 1 is markedly reduced as it goes from a tip end to a longitudinal end because temperature boundary layer 3 where heat is not properly transmitted from the heat transfer pipe 2 disposed on a heat transfer surface of the flat fin 1 becomes thicker in thickness as it goes from the tip end of the flat fin 1 where the fluid is firstly infused to the longitudinal end, as illustrated in FIG. 2.

Furthermore, there is another problem in that the heat is not properly transmitted as illustrated in FIG. 3, beyond approximately 70 to 80 degrees up and down a central axis of the heat transfer pipe 2, in case the fluid of low speed flows in parallel toward the heat transfer pipe 2 in an arrow direction. In other words, because there occurs a cavitation region 4 defined by oblique lines in the rear of the heat transfer pipe 2, it is inevitable that efficiency of the heat exchanger is deteriorated.

Another prior art is disclosed where, as illustrated in FIG. 4, a heat exchanger is so constructed as to have a plurality of louvered grid groups (5*a*, 5*b*, 5*c*, 5*d* and 5*e*) provided at an upper and a lower gap of the plurality of that transfer pipes 2 by way of a direct method without a base part thereon.

In other words, the louver type grid groups (5*a*, 5*b*, 5*c*, 5*d* and 5*e*) are protrudingly disposed, as illustrated in FIG. 5, at a bottom and a superficial side of the flat fin 1, each at the same slanted angle, by way of a cutting process, so that upper and lower ends of the groups (5*a*, 5*b*, 5*c*, 5*d* and 5*e*) are arranged in parallel against a periphery of the pipe 2.

However, there is a disadvantage in the heat exchanger thus constructed in that there is generated a cavitation region at the back of the heat transfer pipe 2 where the air current does not flow and the air current flowing between the plurality of flat fins 1 is not mixed to thereafter flow in straight line, so that there cannot be expected of an increased heat transfer efficiency according to mixture of the air current.

Furthermore, there is another disadvantage in that the louvers are perpendicularly erected against the progressing direction of the air current to thereby increase a pressure-decreasing force, resulting in a reduced heat exchange efficiency.

In this case, although there is an advantage in that although an improved performance of heat exchange between medium in the heat transfer pipe 31 and fluid can be expected because the fluid is agitated to thereby become turbulent around the heat transfer pipe 31, there is still something to be desired in minimizing a cavitation region generating in the rear side of the heat transfer pipe 31.

SUMMARY OF THE INVENTION

Accordingly, the present invention is disclosed to solve the aforementioned disadvantages and it is therefore an object of the present invention to provide a heat exchanger of an air conditioner by which fluid passing through respective flat fins is made turbulent and at the same time mixed, to thereby minimize a generation of unavailable void in the rear of a plurality of heat transfer pipes and to improve a heat exchange efficiency.

It is another object of the present invention to provide a heat exchanger of an air conditioner by which a heat flow from the heat transfer pipes are not interrupted but smoothly transferred, and concurrently a heat transfer pipes to avoid an increased pressure-decreasing force and to thereby increase a heat exchange efficiency.

It is still another object of the present invention to provide a heat exchanger of an air conditioner by which a superficial area of the flat fins is increased and simultaneously a discharge function is provided, enabling concentrated water generated from the heat transfer pipes to be smoothly discharged.

In accordance with the objects of the present invention, there is provided a heat exchanger of an air conditioner having a plurality of flat fins, each arranged in parallel at a predetermined interval to allow fluid to flow thereamong and a plurality of heat transfer pipes insertedly arranged in perpendicular patterns to the plurality of the flat fins to allow the fluid to internally flow, the heat exchanger comprising a plurality of louvered grid groups symmetrically opened in a forward and a reverse flowing direction of air current and radially disposed to encompass an upper and a lower side of the heat transfer pipes, so that the air current flowing though the plurality of flat fins can become turbulent and mixed around the heat transfer pipes to thereby reduce a cavitation region generating at the back of the plurality of heat transfer pipes and concurrently to increase a heat transfer efficiency.

BRIEF DESCRIPTION OF THE DRAWINGS

For fuller understanding of the nature and objects of the invention, reference should be made to the following detailed description taken in conjunction with the accompanying drawings in which.

DETAILED DESCRIPTION OF THE INVENTION

Figure 1:
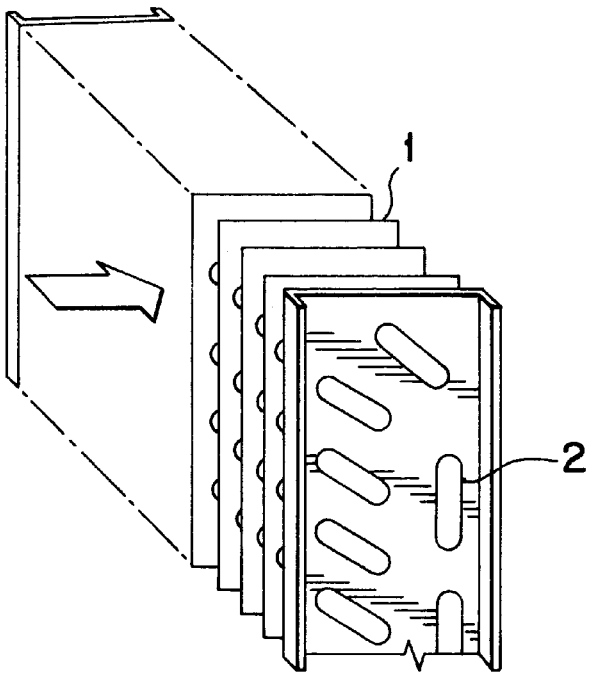
FIG. 1 (PRIOR ART)
FIG. 1 is a perspective view of a heat exchanger according to the prior art.
Figure 2:
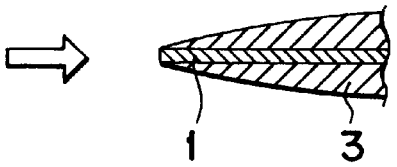
FIG. 2 (PRIOR ART)
FIG. 2 is a schematic drawing for describing heat fluid of the flat fin illustrated in FIG. 1.
Figure 3:
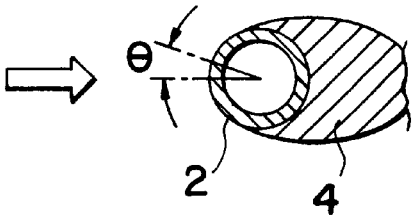
FIG. 3 (PRIOR ART)
FIG. 3 is a schematic drawing for describing the heat fluid around the heat transfer pipe illustrated in FIG. 1.
Figure 4:
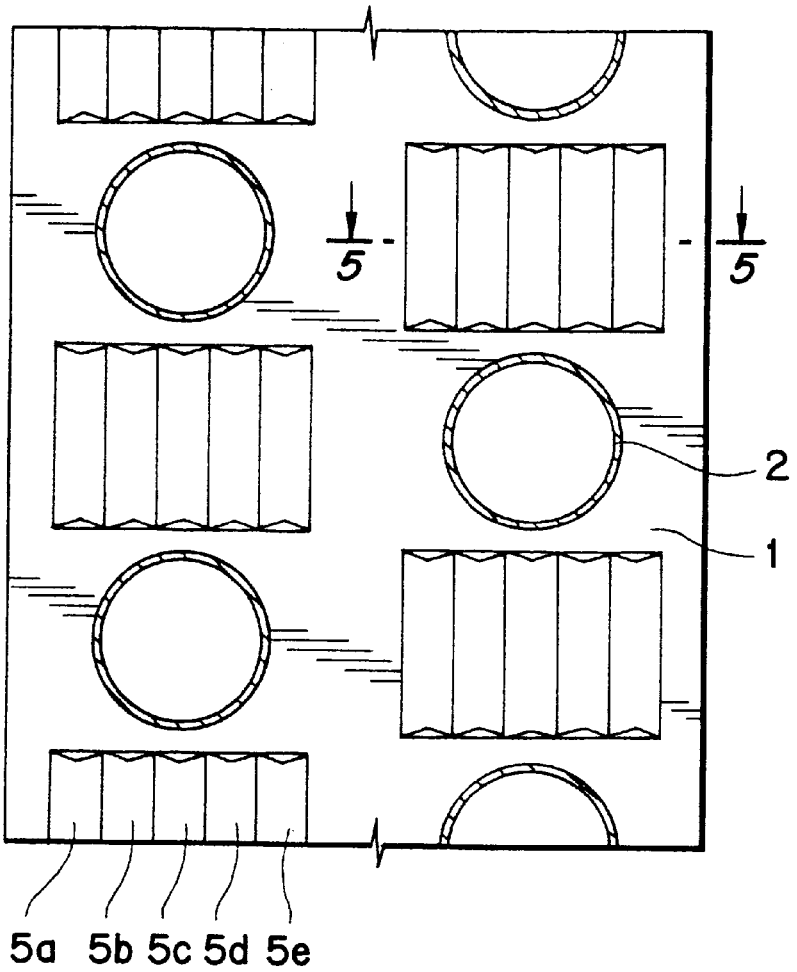
FIG. 4 (PRIOR ART)
FIG. 4 is a plan view for illustrating another heat exchanger according to the prior art.
Figure 5:
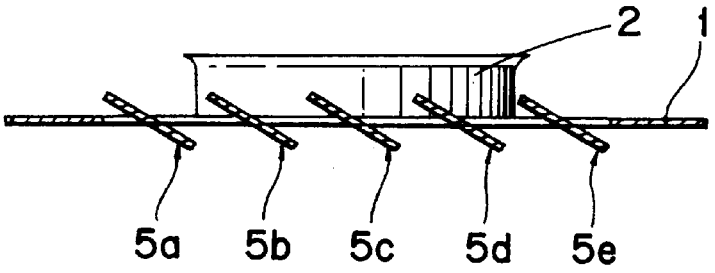
FIG. 5 (PRIOR ART)
FIG. 5 is a sectional view taken along line A—A in FIG. 4.

Now, the preferred embodiments of the present invention will be described in detail with reference to the accompanying drawings.

Throughout the drawings, like reference numerals and symbols are used for designation of like or equivalent parts or portions, for simplicity of illustration and explanation, and redundant references will be omitted.

Figure 6:
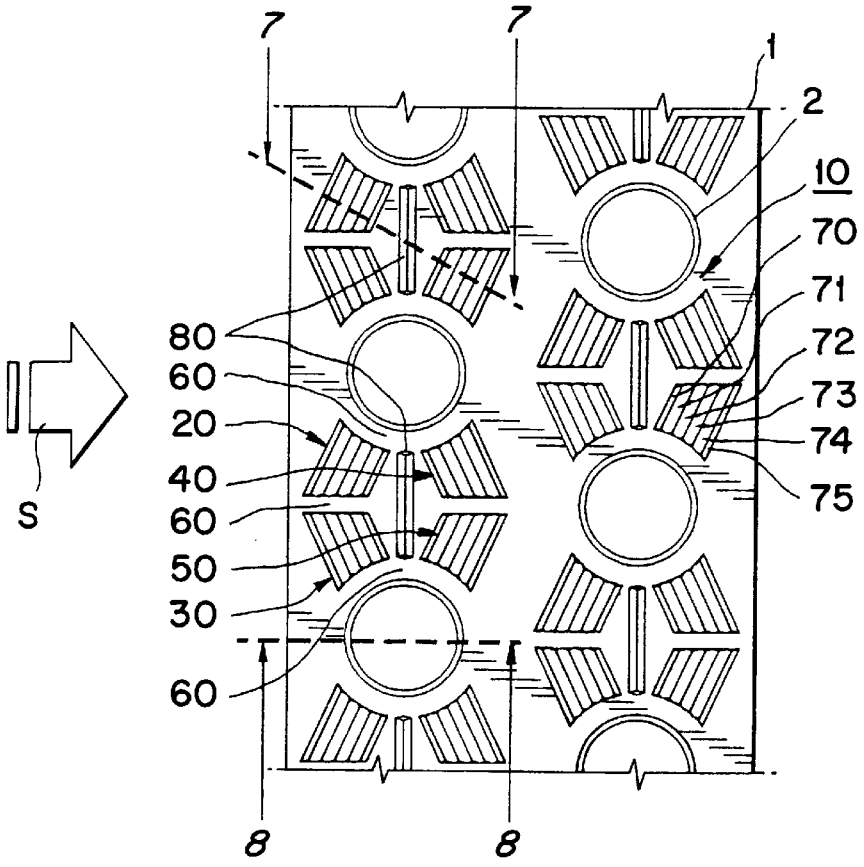
FIG. 6 is a plan view for illustrating flat fins of a heat exchange according to the present invention.

Reference numeral 10 in FIG. 6 represents a plurality of louvered grid groups symmetrically opened in a forward and a reverse flowing direction of air current and radially disposed to encompass an upper and a lower side of peripheral surface at the heat transfer pipes, so that the air current flowing through the plurality of flat fins 1 can become turbulent and mixed around the heat transfer pipes to thereby reduce a cavitation region generating at the back of the plurality of heat transfer pipes and concurrently to increase a heat transfer efficiency.

Figure 7:
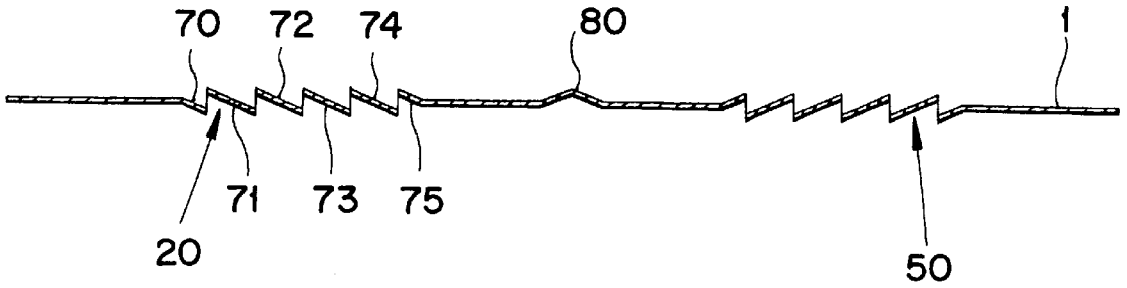
FIG. 7 is a sectional view seen along line B—B in FIG. 5.

In other words, the louvered grid groups includes, as illustrated in FIGS. 6 and 7, a first and a second louvered grid group 20 and 30, each having a symmetrical shape disposed at a frontal upper and a frontal lower side of the heat transfer pipes 2 and respectively and obliquely protruding underneath and above the flat fin 1 so that the air current flowing underneath and above the flat fin 1 can be whirl winded and mixed when it passes from a front part of the plurality of heat transfer pipes 2 to an intermediate part thereof, and a third and a fourth louvered grid group 40 and 50, each having a symmetrical shape at a rear, upper and lower side of the heat transfer pipe 2 and respectively and obliquely protruding underneath and above the flat fins 1, so that the air current dispersed and mixed by the first and the second louvered grid group 20 and 30 can become turbulent and mixed again when it passes from the intermediate part of the plurality of heat transfer pipes 2 and to a rear part thereof.

At this time, the first and the second louvered grid group 20 and 30 are so made by cutting as to protrude underneath the flat fin 1 at a left end thereof and simultaneously to protrude obliquely above an superficial surface the flat fin 1 at a right end thereof so that the groups 20 and 30 are perpendicularly opened toward the progressing direction of the air current which is passing the flat fin 1.

The third and the fourth louvered grid group 40 and 50 are so made by cutting as to protrude toward a superficial side of the flat fin 1 at a left end thereof and concurrently to protrude obliquely toward a bottom surface of the flat fin 1 at a right side thereof so that the groups 30 and 40 are perpendicularly opened toward the progressing direction of the air current which is passing the flat fin 1.

The first and the third louvered grid group 20 and 40 are radially disposed at upper ends thereof around a periphery at the same radius with a predetermined base part 60 lying from a lower peripheral surface of the heat transfer pipe 2, and the second and the fourth louvered grid group 30 and 50 are radially disposed at lower ends thereof around a periphery at the same radius with a predetermined base part 60 lying from an upper peripheral surface of the heat transfer pipe 2.

The first and the third louvered grid group 20 and 40, and the second and the fourth grid group are symmetrically disposed above and underneath a parallel predetermined base part 60 lying therebetween.

The grid groups 20, 30, 40 and 50 are respectively disposed with a plurality of grids 70, 71, 72, 73, 74 and 75 which are continuing crosswise, and the plurality of grids 70, 71, 72, 73, 74 and 75 are so made by cutting as to have no mutual base part therebetween according to a direction method.

FIGS. 6, 7, 8 and 9, reference numeral 80 represents a bead part bent by a bending process and lying centrally against upper and lower sides of the heat transfer pipe 2 so as to increase a superficial area of the flat fin 1 and to concurrently have a draining function where concentrated water generated from the heat transfer pipe 2 can easily be drained out.

Figure 8:
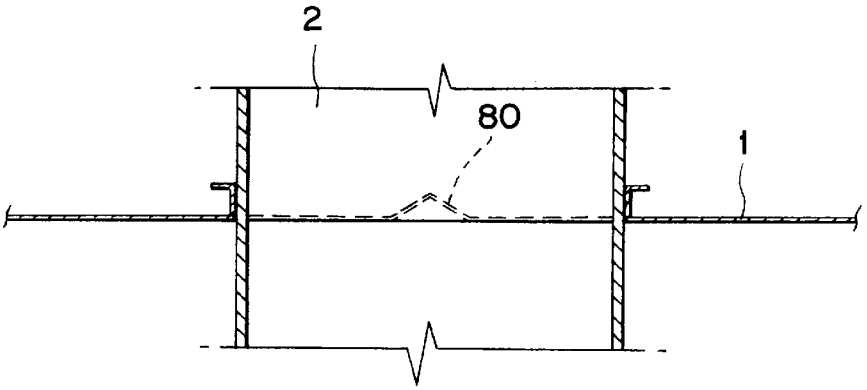
FIG. 8 is a sectional view taken along line C—C in FIG. 6.

In other words, the bead part 80, as illustrated in FIG. 8, is formed with mutually symmetrical inclinations at left and right ends thereof around a central part thereof and is bent inward of the flat fin 1 so as to be provided in the base part 60 between the first and the second louvered grid group 20 and 30, and the third and the fourth louvered grid group 40 and 50, and the bead part 80 is arranged at upper end lower ends thereof on the same extension of the louvered grid group 10 radially disposed with a predetermined base part 60 lying apart from upper and lower peripheral sides of the heat transfer pipe 2.

Next, operational effect of the heat exchanger of an air conditioner according to the embodiment of the present invention thus constructed.

Figure 9:
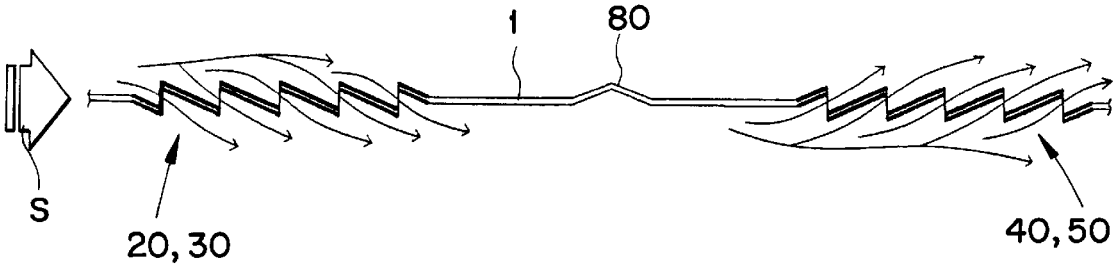
FIG. 9 is a schematic diagram for illustrating flow of air current according to the present invention.

When the air current flows along the arrow S indicated in a full line arrow in FIG. 9, the plurality of grid groups 20, 30, 40 and 50 respectively and obliquely protruded above and underneath the flat fin 1 and is continuously mixed and become turbulent so as to be smoothly transferred from the heat transfer pipe 2 without interruption of heat flow.

In other words, part of the air current flowing underneath the flat fin 1 changes its flow toward the superficial side of the flat fin 1 through the grids 70, 71, 72, 73, 74 and 75 of the first and the second louvered grid group 20 and 30 disposed at the frontal upper and lower sides of the heat transfer pipe 2 so that the flat fin 1 can be perpendicularly opened toward the progressive direction of the air current, and at the same time, is mixed with the mainstream air current flowing toward the superficial side thereof.

Now, the air current which has become mixed and turbulent is not stagnated from the front part of the heat transfer pipe 2 to the intermediate part thereof and instead increased in quantity, and is intensively heat-exchanged to thereby increase a heat transfer efficiency.

Furthermore, part of the air current which has become turbulent as above is changed in its flow toward a bottom side of the flat fin 1 through the grids 70, 71, 72, 73, 74 and 75 of the second and the third louvered grid groups 40 and 50 disposed at the upper and lower back sides of the heat transfer pipe 2 and at the same time, is mixed with the mainstream air current flowing toward a bottom surface of the flat fin 1.

Therefore, the air current becomes more turbulent by mixing phenomenon thereof and again becomes turbulent and mixed smoothly along a periphery of the heat transfer pipe 2 without being interrupted from the front side of the heat transfer pipe 2 to the back side thereof and is transferred to the back side of the heat transfer pipe 2. The air current is drastically reduced in pressure thereof to thereby flow smoothly.

At this time, because the groups 20, 30, 40 and 50 are radially disposed against the upper and lower peripheral side of the heat transfer pipe 2 with a predetermined base part 60 lying therebetween, the turbulent air current which passes the groups 20, 30, 40 and 50 is forced to pass through the back of the heat transfer pipe in larger quantity to thereby reduce the cavitation region to a minimum and the further increase a heat transfer efficiency at the back of the heat transfer pipe 2.

Meanwhile, the bend part 80 bending inward of the flat tin 1 against the gap between the first and second louvered grid group 20 and 30 and the third and fourth louvered grid group 40 and 50 serve to increase the superficial area of the flat fin 1 and guide a smooth drainage of concentrated water (by way of example, dew) generated by temperature difference between the air current flowing through the flat fins 1 and the refrigerant flowing through an inner area of the heat transfer pipe 2 when a heat exchanger is used as an evaporator for cooling or as a concentrator.

As apparent from the foregoing, there is an advantage in the heat exchanger of an air conditioner thus constructed according to the present invention, in that a plurality of louvered grid groups are radially disposed to encompass upper and lower peripheral sides of the heat transfer pipes with a predetermined base part lying therebetween to perpendicularly open louvered grids disposed at the front side of the heat transfer pipes toward the forward direction of the air current and concurrently to perpendicularly open louvered grids disposed at the back of the heat transfer pipes toward the reverse direction of the air current, reducing the air current in pressure thereof to thereby mix and agitate same for an increased heat transfer efficiency.

There is another advantage in that a cavitation region generating at the back of the heat transfer pipes can be reduced, heat flow can be smoothly transferred without being interrupted and a heat transfer can be upgraded among the plurality of the heat transfer pipes as well.

There is still another advantage in that a bead part is bent toward an inner side of the flat fin so as to be centrally and perpendicularly positioned at the louvered grid groups against the upper and lower sides of heat transfer pipes, so that superficial area of the flat fin can be enlarged and concentrated water (by way of example, dew) generated by temperature difference between the refrigerant flowing in the heat transfer pipes and the air current flowing through the flat fins can be smoothly drained out when the beat exchanger is used as an evaporator for cooling or as a concentrator.

What is claimed is:

1. A heat exchanger comprising a plurality of parallel vertical flat fins spaced apart to conduct air flows therebetween, and horizontal pipes extending perpendicularly through the fins and adapted to conduct a refrigerant, each fin comprising a body having arrays of louver groups formed therein; each array disposed between a pair of vertically spaced ones of the pipes, each array consisting of first, second, third and fourth louver groups, whereby there are no more than four louver groups disposed between each vertically spaced pair of pipes;

the first and third louver groups disposed below an upper one of the pipes, the third louver group disposed behind the first louver group with reference to a direction of air flow; the second and fourth louver groups disposed above a lower one of the pipes, the fourth louver group disposed behind the second louver group;

each louver group including a plurality of louvers forming straight slits passing through the body, adjacent ones of the louvers of each louver group being spaced apart solely by one of the slits, the slits extending transversely relative to the air flow direction and generally radially with respect to the respective pipe, there being no slits disposed along a vertical line passing through the axes of both of the upper and lower pipes;

the first and second louver groups being symmetrical with respect to the third and fourth louver groups about the vertical line; the first and third louver groups being symmetrical with respect to the second and fourth louver groups about a horizontal line disposed midway between the upper and lower pipes; the first and second louver groups disposed to the front of their respective pipes, and the third and fourth louver groups disposed to the rear of their respective pipes, each louver lying in a plane oriented at an oblique angle with respect to a plane of the fin; the louvers of the first and second groups being inclined oppositely with respect to the louvers of the third and fourth groups.

2. The heat exchanger according to claim 1 wherein adjacent ones of the louvers of each louver group are spaced apart solely by one of the slits.

3. The heat exchanger according to claim 1 wherein the fin further includes a vertical bead extending along the vertical line passing through the axes of the upper and lower pipes.

4. The heat exchanger according to claim 3 wherein the bead has a V-shaped cross section.

* * * * *